US009013252B1

(12) United States Patent
Lin et al.

(10) Patent No.: US 9,013,252 B1
(45) Date of Patent: Apr. 21, 2015

(54) PEDESTAL-BASED DIELECTRIC-LOADED CAVITY RESONATOR

(71) Applicant: Alcatel-Lucent USA Inc., Murray Hill, NJ (US)

(72) Inventors: Tsu-Wei Lin, Piscataway, NJ (US); Noriaki Kaneda, Westfield, NJ (US)

(73) Assignee: Alcatel Lucent, Boulogne-Billancourt (FR)

( * ) Notice: Subject to any disclaimer, the term of this patent is extended or adjusted under 35 U.S.C. 154(b) by 0 days.

(21) Appl. No.: 14/060,946

(22) Filed: Oct. 23, 2013

(51) Int. Cl.
*H01P 7/10* (2006.01)
*H01P 1/20* (2006.01)

(52) U.S. Cl.
CPC ..... *H01P 7/10* (2013.01); *H01P 1/2002* (2013.01)

(58) Field of Classification Search
CPC ..... H01P 1/20309; H01P 1/20318; H01P 1/2084; H01P 1/2086
USPC ..... 333/202, 204, 212, 219, 219.1, 227
See application file for complete search history.

(56) References Cited

U.S. PATENT DOCUMENTS

| | | | | |
|---|---|---|---|---|
| 4,996,506 | A * | 2/1991 | Ishikawa et al. | 333/219.1 |
| 6,262,639 | B1 * | 7/2001 | Shu et al. | 333/202 |
| 6,882,252 | B1 * | 4/2005 | Cros et al. | 333/219.1 |
| 8,773,222 | B2 * | 7/2014 | Myllyvainio et al. | 333/202 |

FOREIGN PATENT DOCUMENTS

| | | |
|---|---|---|
| EP | 0 465 059 B1 | 1/1996 |

OTHER PUBLICATIONS

Kumar Vaibhav Srivastava et al., "A Modified Ring Dielectric Resonator With Improved Mode Separation and Its Tunability Characteristics in MIC Environment," IEEE Transactions on Microwave Theory and Techniques, vol. 53, No. 6, Jun. 2005, pp. 1960-1967.

* cited by examiner

*Primary Examiner* — Jeffrey Zweizig

(74) *Attorney, Agent, or Firm* — Mendelsohn, Drucker & Dunleavy, P.C.; Steve Mendelsohn

(57) ABSTRACT

A dielectric-loaded cavity resonator has a conductive (e.g., copper) box defining a cavity and a dielectric (e.g., ceramic) resonator mounted within the box. The dielectric resonator has a cylindrical dielectric post and first and second dielectric pedestals respectively connected to the ends of the post and having lateral dimensions greater than the diameter of the post. Insulating (e.g., PTFE) pads are mounted onto outer surfaces of the pedestals to provide air gaps between the pedestals and corresponding top and bottom walls of the box. In certain embodiments, the pedestals have rectilinear, 3D shapes completely or only partially covering the top and bottom walls of the cavity, while, in other embodiments, the pedestals have cylindrical shapes maximally or less than maximally covering the top and bottom walls of the cavity.

17 Claims, 7 Drawing Sheets

TABLE I

| Pedestal thickness (mm) | Center (GHz) | First Harmonic (GHz) | Q | Post diameter (mm) |
|---|---|---|---|---|
| 1 mm | 2.6056 | 4.349 | 6870.25 | 9.02 |
| 2 mm | 2.6014 | 4.347 | 7094.7 | 8.26 |
| 3 mm | 2.6063 | 3.948 | 7026.38 | 7.68 |
| 4 mm | 2.6061 | 3.449 | 6947.88 | 7.16 |

FIG. 3

PEDESTAL-BASED DIELECTRIC-LOADED CAVITY RESONATOR

BACKGROUND

1. Field

The disclosure relates to electronics and, more specifically but not exclusively, to dielectric-loaded cavity resonators.

2. Description of the Related Art

This section introduces aspects that may help facilitate a better understanding of the disclosure. Accordingly, the statements of this section are to be read in this light and are not to be understood as admissions about what is in the prior art or what is not in the prior art.

Dielectric-loaded cavity resonators are often used as band-pass filters for RF (radio frequency) transmission systems. A conventional cavity resonator has a metal box defining a cavity within which is located a cylindrical dielectric resonator. The under-damping of a cavity resonator is characterized by its Q factor, where higher Q indicates a lower rate of energy loss relative to the stored energy of the resonator. In many RF signal processing applications, it is desirable to employ cavity resonators that have high Q factors. It is also often desirable to employ cavity resonators that are as small as possible. Unfortunately, in general, the smaller the size of a cavity resonator, the smaller the Q factor. It is therefore advantageous to design relatively small cavity resonators with relatively high Q factors.

SUMMARY OF SOME SPECIFIC EMBODIMENTS

According to one embodiment, provided is a dielectric-loaded cavity resonator comprising (i) a conductive box defining a cavity and (ii) a dielectric resonator mounted within the box. The dielectric resonator comprises (1) a cylindrical dielectric post and (2) first and second dielectric pedestals respectively connected to first and second ends of the post and having lateral dimensions greater than the diameter of the post.

BRIEF DESCRIPTION OF THE DRAWINGS

Other aspects, features, and benefits of various embodiments of the disclosure will become more fully apparent, by way of example, from the following detailed description and the accompanying drawings, in which:

FIG. 3 shows Table I, which presents the center frequency, first harmonic frequency, and Q factor for four different implementations of the cavity resonator of FIG. 2 having four different combinations of pedestal thickness and post diameter;

DETAILED DESCRIPTION

Figure 1:
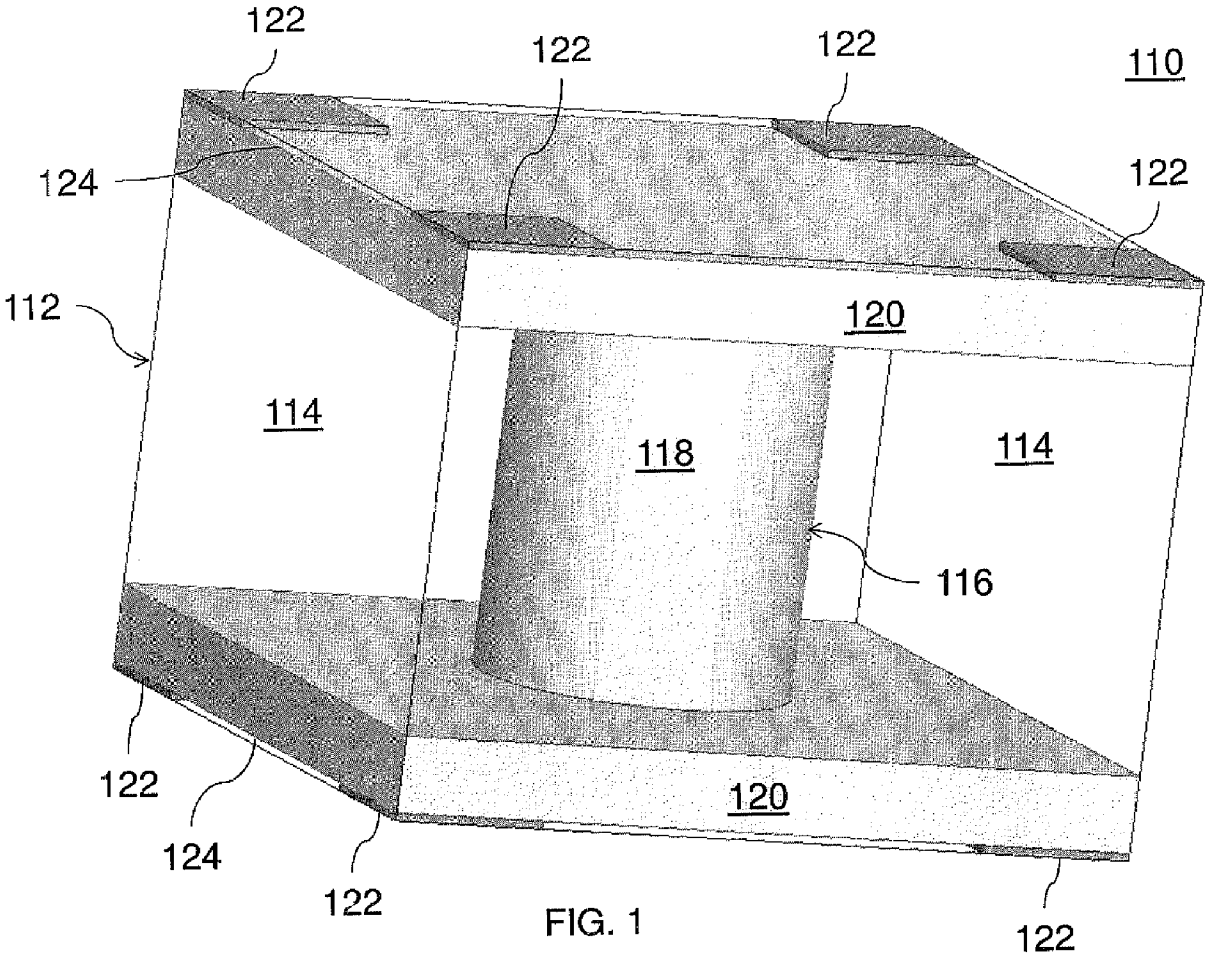
FIG. 1 shows a perspective X-ray view of a dielectric-loaded cavity resonator according to an embodiment of the disclosure.

FIG. 1 shows a perspective X-ray view of a dielectric-loaded cavity resonator 110 according to an embodiment of the disclosure. Cavity resonator 110 comprises a conductive (e.g., metal such as copper or other suitable conducting material) box 112 having six rectangular walls (i.e., four rectangular side walls, a square bottom wall, and a square top wall), which define a rectilinear, three-dimensional (3D) cavity 114. Located inside the cavity 114 is a dielectric (e.g., ceramic or other suitable dielectric material) resonator (DR) 116. Dielectric resonator 116 comprises a cylindrical dielectric post 118 located between two rectilinear, 3D dielectric pedestals 120.

As used herein, the term "cavity resonator" refers to the entire resonator device (i.e., the conductive box and the dielectric resonator), while the term "dielectric resonator" refers only to the dielectric element located within the cavity defined by the conductive box of the cavity resonator.

In a preferred implementation, the lateral dimensions (i.e., length and width) of each pedestal 120 are equal to the corresponding lateral dimensions of cavity 114, such that the four side walls of each pedestal abut the four corresponding side walls of the box 112, and the rectilinear pedestal completely covers (i.e., spans across the entire area of) the corresponding rectilinear top/bottom wall of the cavity in both lateral dimensions.

Although post 118 is a solid cylinder of dielectric material in the embodiment of FIG. 1, in alternative embodiments, the post may be hollow, such that the post is defined, for example, by concentric inner and outer cylindrical surfaces.

Four insulating (e.g., polytetrafluoroethylene (PTFE), ceramic, or other suitable insulating material) pads 122 are located on the outer (i.e., top/bottom) surface of each pedestal and function as spacers that define an air gap 124 between the rest of the outer surface of each pedestal and the corresponding top/bottom wall of the box 112.

In one exemplary implementation, the inner dimensions of cavity 114 are 20 mm (long)×20 mm (wide)×15 mm (high), the dimensions of each pedestal 120 are 20 mm (long)×20 mm (wide)×2 mm (high), post 118 has a diameter of 8.18 mm and a height of 10.6 mm, and pads 122 are 0.2 mm thick, which implies that each air gap 124 is also 0.2 mm high. In addition, box 112 is made of copper, dielectric resonator 116 is made of a ceramic material having a dielectric constant of 43 and a loss tangent (aka tangent delta) of $5.882\times10^{-5}$, and pads 122 are made of PTFE having a dielectric constant of 2.0 and a loss tangent of 0.0003. For this exemplary implementation, cavity resonator 110 has its center frequency at 2.607 GHz, its first harmonic frequency at 4.282 GHz, a mode separation of 64.25%, and a Q factor or 7276.68, which is about 22% better than the Q factor of 5953.19 for a comparably sized, prior-art cavity resonator having a cylindrical DR with a diameter of 11.48 mm and no pedestals. Furthermore, the mode separation for that prior-art cavity resonator is only about 43%.

Although this example demonstrates that cavity resonators of the disclosure can achieve higher Q factors than comparably sized cavity resonators of the prior art, in alternative implementations, the prior-art Q factor can be achieved using cavity resonators of the disclosure that are smaller than the corresponding cavity resonators of the prior art. The competing characteristics of size and Q factor can be traded off to provide cavity resonators of the disclosure that both (i) are smaller than and (ii) have higher Q factors than cavity resonators of the prior art.

Figure 2:
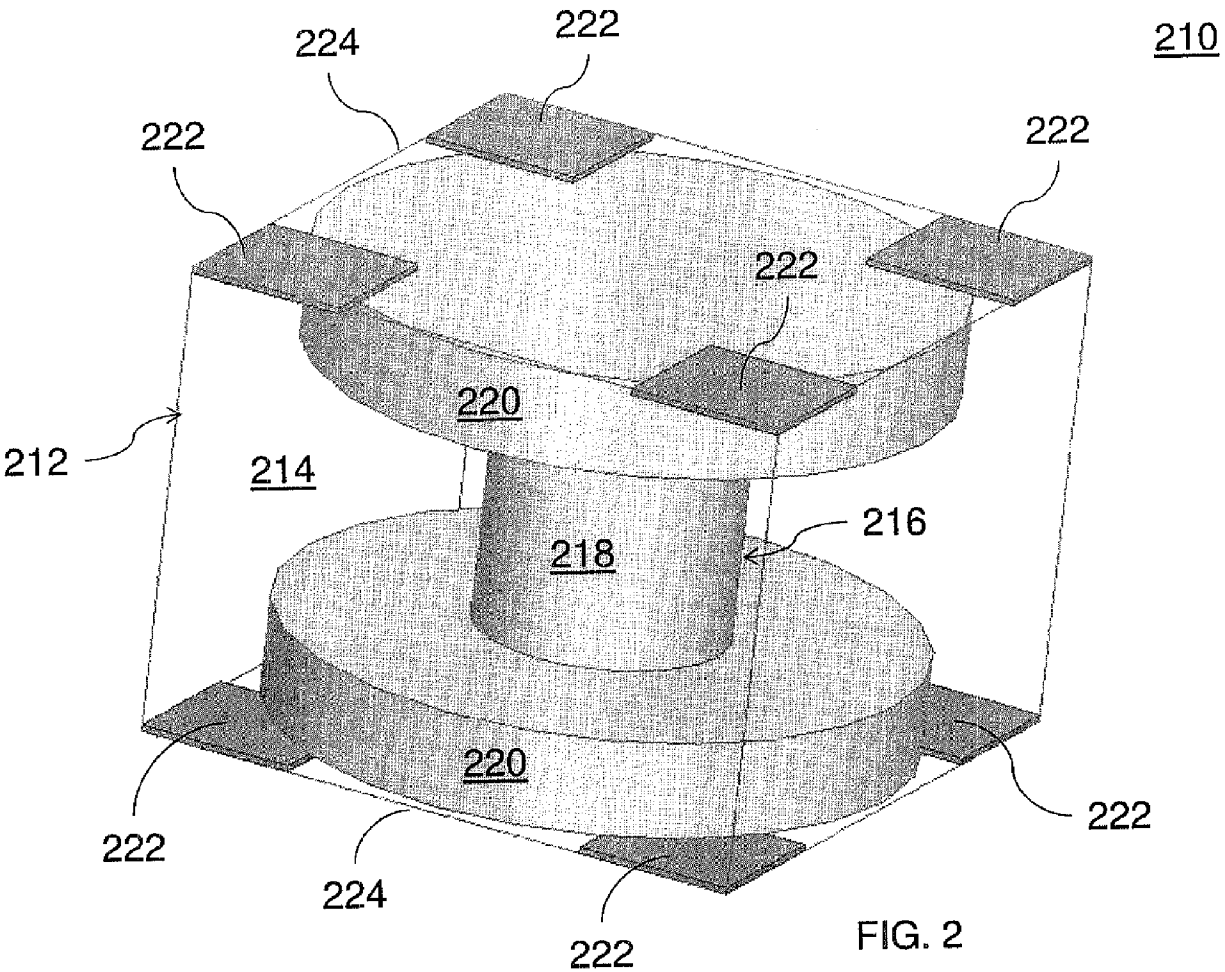
FIG. 2 shows a perspective X-ray view of a dielectric-loaded cavity resonator according to another embodiment of the disclosure.

FIG. 2 shows a perspective X-ray view of a dielectric-loaded cavity resonator 210 according to another embodiment of the disclosure. Like cavity resonator 110 of FIG. 1, cavity resonator 210 has a pedestal-based design with analogous features 212-224 having analogous labels, except that, in cavity resonator 210, the two dielectric pedestals 220 are cylindrical (with circular lateral cross sections) instead of rectilinear (with square lateral cross sections) as in cavity resonator 110. In some implementations, the diameter of each pedestal 220 is equal to the length/width of the cavity 214, such that each pedestal covers a maximum amount of each corresponding top/bottom wall of box 212.

FIG. 3 shows Table I, which presents the center frequency, first harmonic frequency, and Q factor for four different implementations of cavity resonator 210 of FIG. 2 having four different combinations of pedestal (220) thickness and post (218) diameter. In general, as pedestal thickness increases, the same Q factor can be achieved by decreasing the post diameter, but only with a corresponding decrease in mode separation.

As with conventional cavity resonators, two or more cavity resonators of the disclosure can be configured together in linear or two-dimensional combinations to provide RF filters having multiple poles.

Figure 4A:
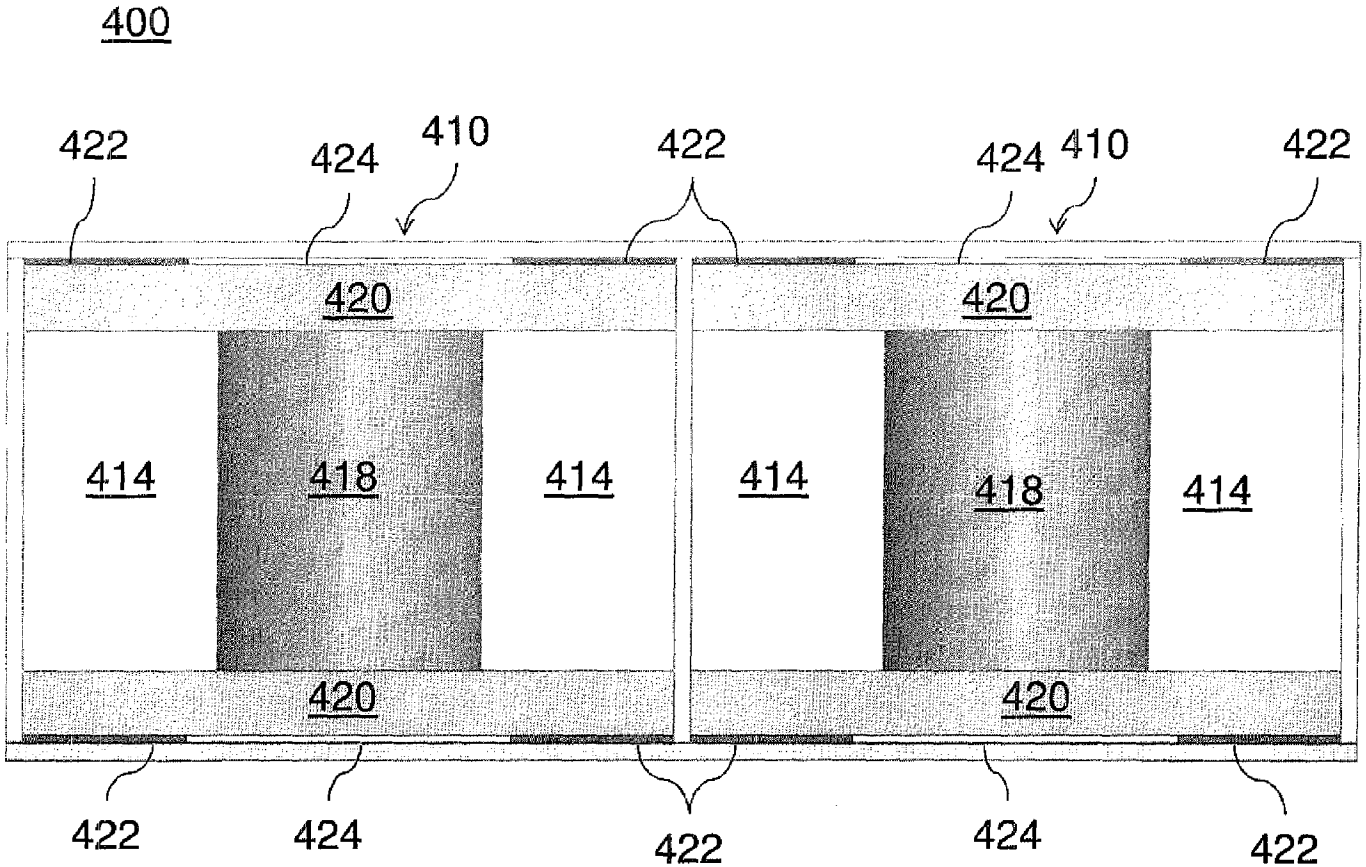
FIGS. 4(A) and 4(B) respectively show a X-ray side view and a cut-away perspective view of a two-pole filter formed by configuring together two cavity resonators of the disclosure.
Figure 4B:
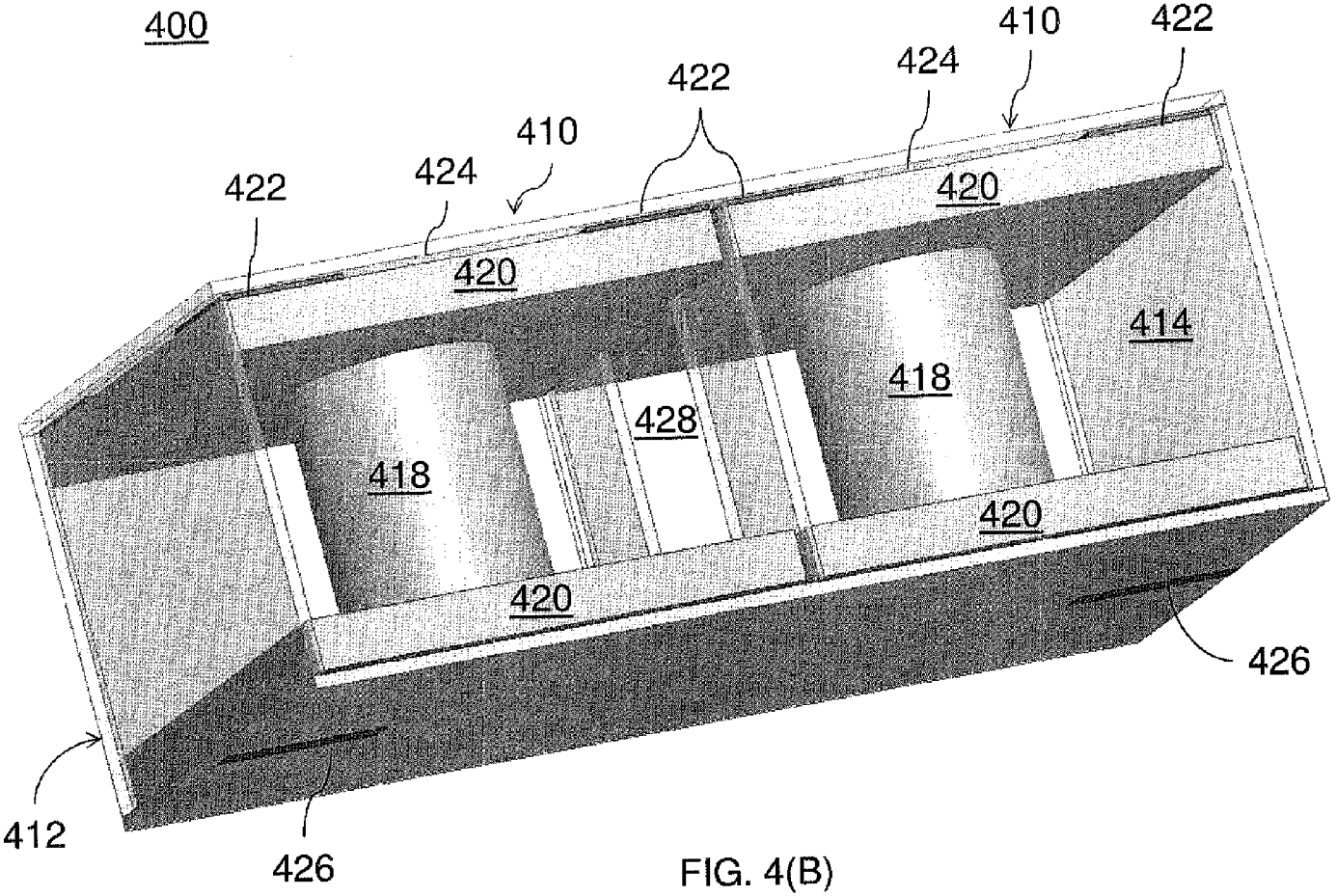

FIGS. 4(A) and 4(B) respectively show a X-ray side view and a cut-away perspective view of a two-pole filter 400 formed by configuring together two cavity resonators 410 of the disclosure. FIG. 4(A) shows air gaps 424 defined by pads 422 located between the outer (i.e., top/bottom) surfaces of rectilinear pedestals 420 and the corresponding inner top/bottom walls of the cavity resonators. As shown in FIG. 4(B), the two cavity resonators are fed by two micro-strip lines 426. FIG. 4(B) also shows iris 428, which is an opening in the intermediate side wall shared by the two cavity resonators. Iris 428 enables the coupling between the two cavity resonators 410 that allows the entire structure 400 to function as a single, integrated, two-pole filter.

Figure 5A:
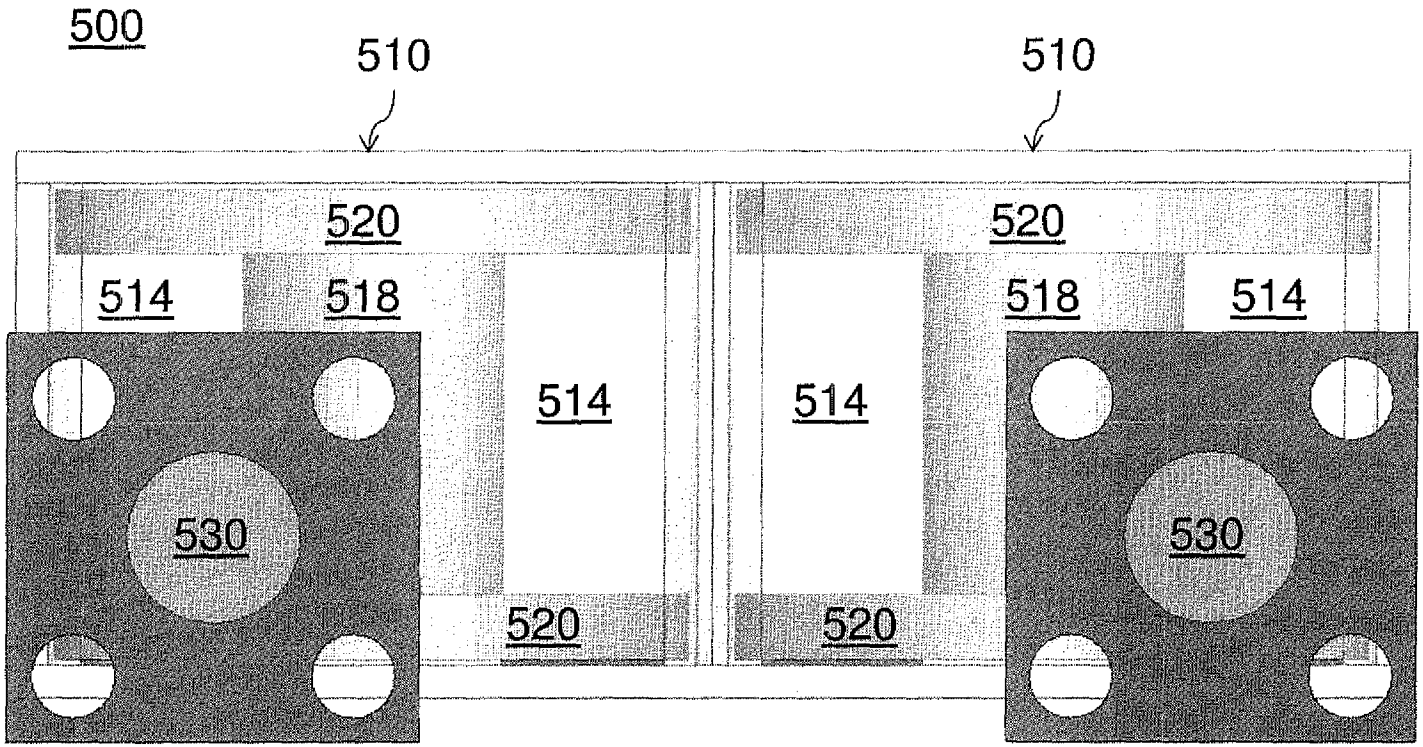
FIGS. 5(A) and 5(B) respectively show a partial X-ray side view and a cut-away, perspective partial X-ray view of another two-pole filter formed by configuring together two cavity resonators of the disclosure.
Figure 5B:
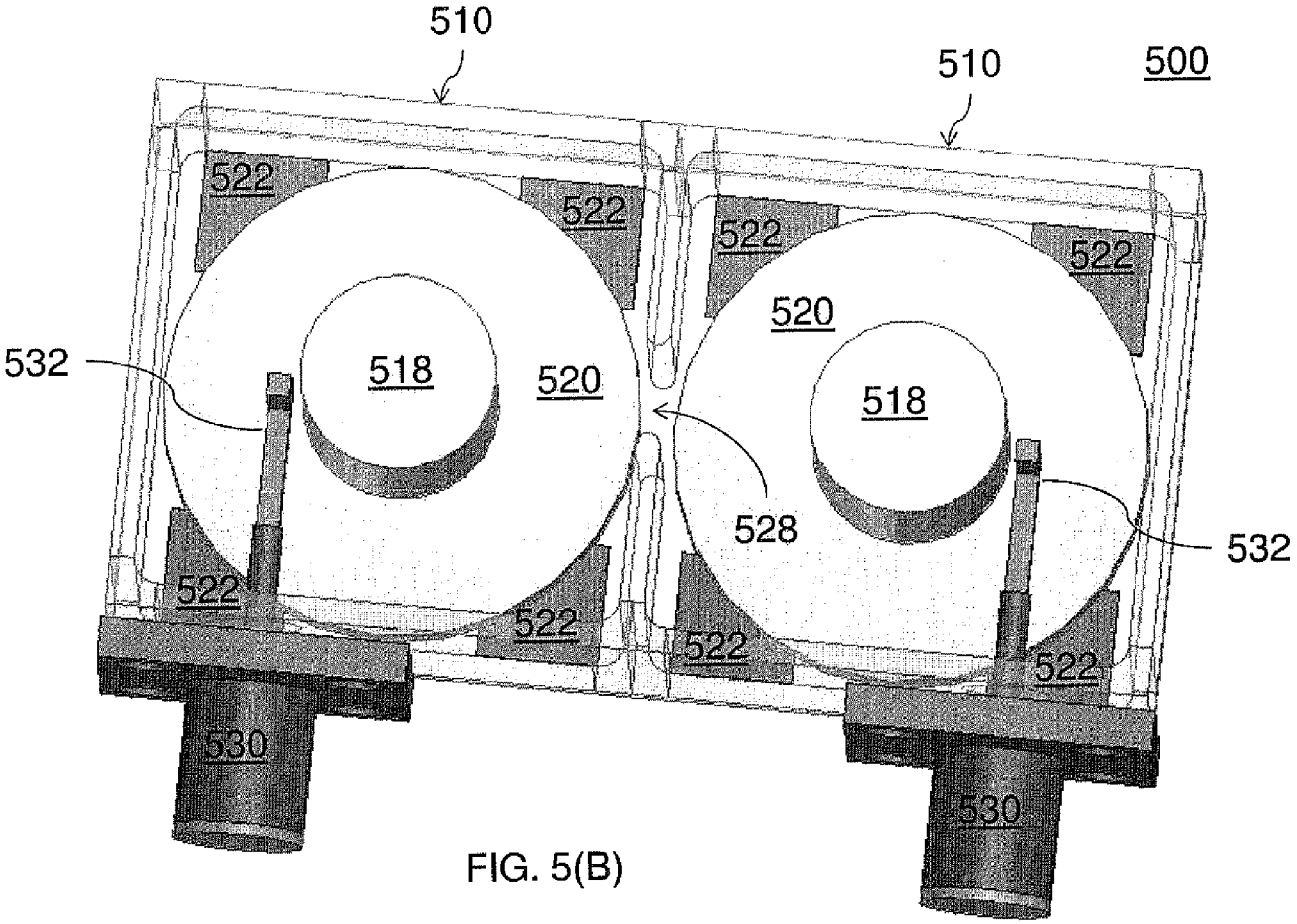

FIGS. 5(A) and 5(B) respectively show a partial X-ray side view and a cut-away, perspective, partial X-ray view of another two-pole filter 500 of the disclosure. Note that the top walls as well as the upper pedestals of the two cavity resonators 510 are excluded from the cut-away view shown in FIG. 5(B). In this two-pole filter, the two cavity resonators 510 are fed using coaxial probes 530, each having an L-shaped center pin 532 adjacent to a corresponding DR post 518. FIG. 5(B) also shows iris 528.

Although the disclosure has been described in the context of cavity resonators having air gaps at both ends of the dielectric resonator, in alternative embodiments, one or both air gaps may be omitted.

Although the disclosure has been described in the context of cavity resonators having rectilinear 3D pedestals and cylindrical pedestals that cover as much of the top and bottom walls of the cavity as possible, in alternative embodiments, the lateral dimensions of the pedestals may be smaller such that more of the top and bottom cavity walls are left uncovered by the lateral areas of the pedestals.

In some embodiments of at least one of the above cavity resonators, each pedestal has a rectilinear, three-dimensional shape whose length and width are greater than the diameter of the post.

In some embodiments of at least one of the above cavity resonators, each pedestal covers a corresponding top or bottom wall of the cavity.

In some embodiments of at least one of the above cavity resonators, each pedestal has a cylindrical shape whose diameter is greater than the diameter of the post.

In some embodiments of at least one of the above cavity resonators, top and bottom walls of the cavity have a square shape, and the diameter of each pedestal is equal to the width of the corresponding top or bottom wall of the cavity.

In some embodiments of at least one of the above cavity resonators, a first air gap exists between the first pedestal and a first corresponding wall of the box.

In some embodiments of at least one of the above cavity resonators, the cavity resonator further comprises a plurality of insulating pads positioned between the first pedestal and the first corresponding wall of the box to define the first air gap.

In some embodiments of at least one of the above cavity resonators, a second air gap exists between the second pedestal and a second corresponding wall of the box.

In some embodiments of at least one of the above cavity resonators, the cavity resonator further comprises a micro-strip line configured to feed the cavity resonator.

In some embodiments of at least one of the above cavity resonators, the cavity resonator further comprises a coaxial probe configured to feed the cavity resonator.

In some embodiments of at least one of the above cavity resonators, the cavity resonator further comprises (i) a first set of four insulating pads positioned between the first pedestal and a first corresponding wall of the box to define a first air gap between the first pedestal and the first corresponding wall of the box and (ii) a second set of four insulating pads positioned between the second pedestal and a second corresponding wall of the box to define a second air gap between the second pedestal and the second corresponding wall of the box.

In some embodiments of at least one of the above cavity resonators, the first and second pedestals have rectilinear, three-dimensional shapes whose lengths and widths are greater than the diameter of the post, and the first and second pedestals cover corresponding walls of the cavity.

In some embodiments of at least one of the above cavity resonators, the first and second pedestals have cylindrical shapes whose diameters are greater than the diameter of the post, top and bottom walls of the cavity have square shape, and the diameter of the first and second pedestal is equal to the width of the corresponding top or bottom wall of the cavity.

In some embodiments of at least one of the above cavity resonators, the conductive box is made of copper, the dielectric resonator is made of ceramic, and the insulating pads are made of polytetrafluoroethylene.

In some embodiments of at least one of the above cavity resonators, a multi-pole filter comprises two or more of the dielectric-loaded cavity resonators configured into a single integrated device.

While this disclosure has been described with reference to illustrative embodiments, this description is not intended to be construed in a limiting sense. Various modifications of the described embodiments, as well as other embodiments of the disclosure, which are apparent to persons skilled in the art to which the disclosure pertains are deemed to lie within the principle and scope of the disclosure as expressed in the following claims.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this disclosure may be made by those skilled in the art without departing from the scope of the disclosure as expressed in the following claims.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments. The same applies to the term "implementation."

The description and drawings merely illustrate the principles of the disclosure. It will thus be appreciated that those of ordinary skill in the art will be able to devise various arrangements that, although not explicitly described or shown herein, embody the principles of the disclosure and are included within its spirit and scope. Furthermore, all examples recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions. Moreover, all statements herein reciting principles, aspects, and embodiments of the disclosure, as well as specific examples thereof, are intended to encompass equivalents thereof.

What is claimed is:

1. A dielectric-loaded cavity resonator comprising:
a conductive box defining a cavity; and
a dielectric resonator mounted within the box and comprising:
a cylindrical dielectric post; and
first and second dielectric pedestals respectively connected to first and second ends of the post and having lateral dimensions greater than the diameter of the post.

2. The cavity resonator of claim 1, wherein each pedestal has a rectilinear, three-dimensional shape whose length and width are greater than the diameter of the post.

3. The cavity resonator of claim 2, wherein each pedestal covers a corresponding top or bottom wall of the cavity.

4. The cavity resonator of claim 1, wherein each pedestal has a cylindrical shape whose diameter is greater than the diameter of the post.

5. The cavity resonator of claim 4, wherein:
top and bottom walls of the cavity have a square shape; and
the diameter of each pedestal is equal to the width of the corresponding top or bottom wall of the cavity.

6. The cavity resonator of claim 1, wherein a first air gap exists between the first pedestal and a first corresponding wall of the box.

7. The cavity resonator of claim 6, further comprising a plurality of insulating pads positioned between the first pedestal and the first corresponding wall of the box to define the first air gap.

8. The cavity resonator of claim 6, wherein a second air gap exists between the second pedestal and a second corresponding wall of the box.

9. The cavity resonator of claim 1, further comprising a micro-strip line configured to feed the cavity resonator.

10. The cavity resonator of claim 1, further comprising a coaxial probe configured to feed the cavity resonator.

11. The cavity resonator of claim 1, further comprising:
a first set of four insulating pads positioned between the first pedestal and a first corresponding wall of the box to define a first air gap between the first pedestal and the first corresponding wall of the box; and
a second set of four insulating pads positioned between the second pedestal and a second corresponding wall of the box to define a second air gap between the second pedestal and the second corresponding wall of the box.

12. The cavity resonator of claim 11, wherein:
the first and second pedestals have rectilinear, three-dimensional shapes whose lengths and widths are greater than the diameter of the post; and
the first and second pedestals cover corresponding walls of the cavity.

13. The cavity resonator of claim 11, wherein:
the first and second pedestals have cylindrical shapes whose diameters are greater than the diameter of the post;
top and bottom walls of the cavity have square shape; and
the diameter of the first and second pedestal is equal to the width of the corresponding top or bottom wall of the cavity.

14. The cavity resonator of claim 11, wherein:
the conductive box is made of copper;
the dielectric resonator is made of ceramic; and
the insulating pads are made of polytetrafluoroethylene or ceramic.

15. The cavity resonator of claim 1, having a center frequency of about 2.6 GHz and a Q factor of greater than 6800.

16. A multi-pole filter comprising two or more of the dielectric-loaded cavity resonators of claim 1 configured into a single integrated device.

17. A multi-pole filter comprising two or more of the dielectric-loaded cavity resonators of claim 11 configured into a single integrated device.

* * * * *